US011817062B2

(12) United States Patent
Ko et al.

(10) Patent No.: US 11,817,062 B2
(45) **Date of Patent: *Nov. 14, 2023**

(54) SYSTEM AND METHOD FOR OVERDRIVE SETTING CONTROL ON A LIQUID CRYSTAL DISPLAY

(71) Applicant: DELL PRODUCTS, LP, Round Rock, TX (US)

(72) Inventors: Hyunseok Ko, Seochogu (SG); Guentaek Oh, Paju (SG)

(73) Assignee: Dell Products L.P., Round Rock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/552,801

(22) Filed: Dec. 16, 2021

(65) Prior Publication Data

US 2022/0139346 A1 May 5, 2022

Related U.S. Application Data

(63) Continuation of application No. 17/089,339, filed on Nov. 4, 2020, now Pat. No. 11,257,447.

(51) Int. Cl.
*G09G 3/36* (2006.01)
*G09G 3/20* (2006.01)

(52) U.S. Cl.
CPC ..... *G09G 3/36* (2013.01); *G09G 3/2096* (2013.01); *G09G 2310/08* (2013.01); *G09G 2354/00* (2013.01); *G09G 2360/12* (2013.01)

(58) Field of Classification Search
None
See application file for complete search history.

(56) References Cited

U.S. PATENT DOCUMENTS

| | | | | |
|---|---|---|---|---|
| 8,049,741 | B2 | 11/2011 | Knepper et al. | |
| 10,670,234 | B1 | 6/2020 | Oh et al. | |
| 10,705,781 | B1 | 7/2020 | Guo et al. | |
| 11,257,447 | B1 * | 2/2022 | Ko | G09G 3/3648 |
| 2014/0198093 | A1 * | 7/2014 | Nambi | G09G 3/3611 345/212 |
| 2020/0233625 | A1 | 7/2020 | Guo et al. | |
| 2020/0241359 | A1 | 7/2020 | Kim et al. | |

* cited by examiner

*Primary Examiner* — Ifedayo B Iluyomade
(74) *Attorney, Agent, or Firm* — Larson Newman, LLP

(57) ABSTRACT

A monitor includes a timing controller coupled to a liquid crystal display panel. A scaler unit receives a change event notification associated with a change to a new overdrive setting of the liquid crystal display panel, and determines a set of lookup table values associated with the change to the new overdrive setting of the liquid crystal display panel. The scaler unit determines a size of data to be transmitted based on the set of lookup table values, and divides the data to be transmitted into data portions based on factors that include the size of the data to be transmitted, speed of an inter-integrated circuit bus, or length of a vertical blank period. The scaler unit then transmits one of the data portions during the vertical blank period via the inter-integrated circuit bus.

19 Claims, 8 Drawing Sheets

SYSTEM AND METHOD FOR OVERDRIVE SETTING CONTROL ON A LIQUID CRYSTAL DISPLAY

CROSS-REFERENCE TO RELATED APPLICATION

This application is a Continuation of U.S. patent application Ser. No. 17/089,339 entitled "SYSTEM AND METHOD FOR OVERDRIVE SETTING CONTROL ON A LIQUID CRYSTAL DISPLAY" filed on Nov. 4, 2020, the disclosure of which is hereby expressly incorporated by reference in its entirety.

FIELD OF THE DISCLOSURE

The present disclosure generally relates to information handling systems, and more particularly relates to overdrive setting control on a liquid crystal display.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus, information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

A monitor includes a timing controller coupled to a liquid crystal display panel. A scaler unit receives a change event notification associated with a change to a new overdrive setting of the liquid crystal display panel, and determines a set of lookup table values associated with the change to the new overdrive setting of the liquid crystal display panel. The scaler unit determines a size of data to be transmitted based on the set of lookup table values, and divides the data to be transmitted into data portions based on factors that include the size of the data to be transmitted, speed of an inter-integrated circuit bus, or length of a vertical blank period. The scaler unit then transmits one of the data portions during the vertical blank period via the inter-integrated circuit bus.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings and is provided to assist in describing the teachings. This focus should not be interpreted as a limitation on the scope or applicability of the teachings.

Figure 1:
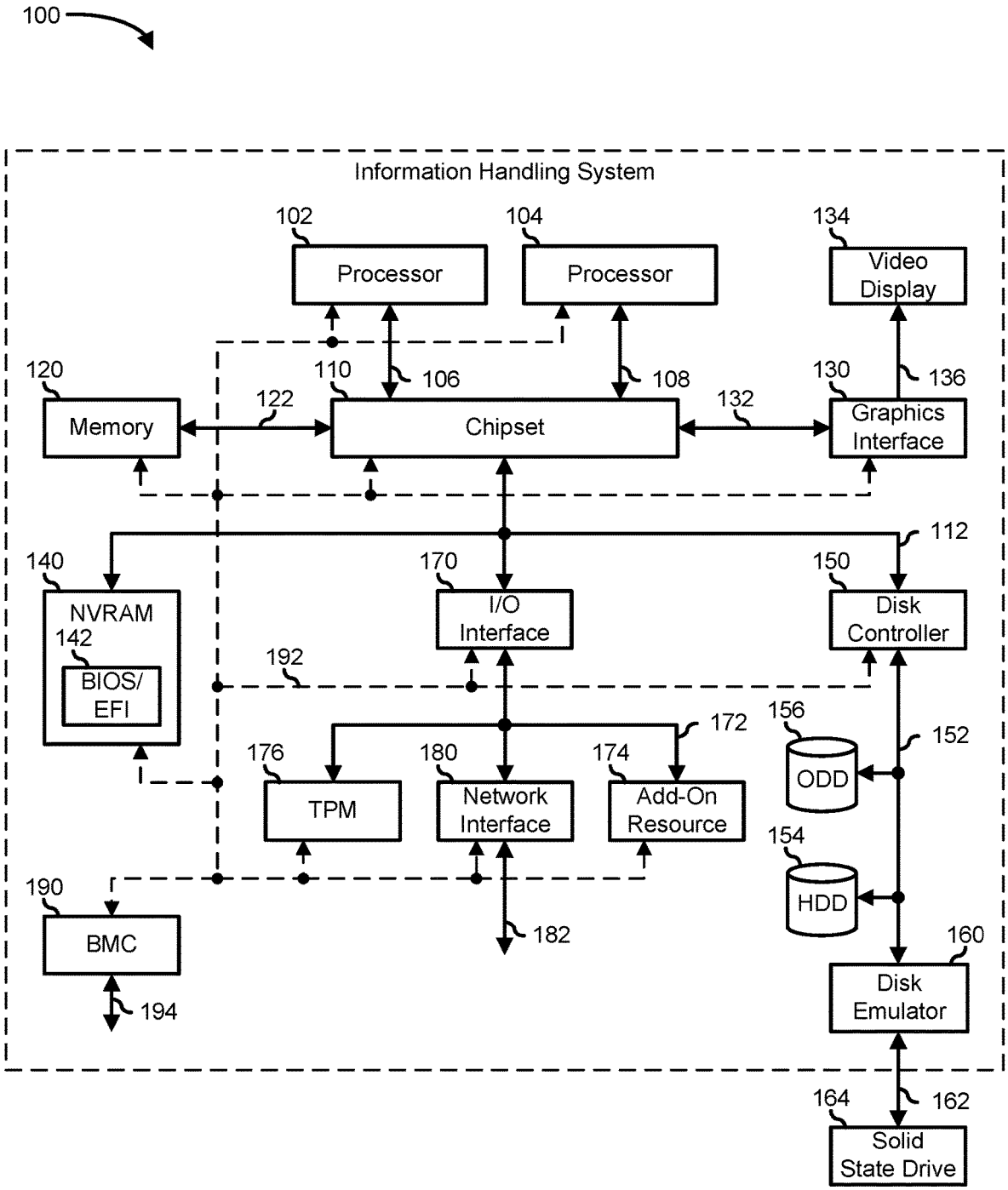
FIG. 1 is a block diagram illustrating an information handling system according to an embodiment of the present disclosure.

FIG. 1 illustrates an embodiment of an information handling system 100 including processors 102 and 104, a chipset 110, a memory 120, a graphics adapter 130 connected to a video display 134, a non-volatile RAM (NV-RAM) 140 that includes a basic input and output system/extensible firmware interface (BIOS/EFI) module 142, a disk controller 150, a hard disk drive (HDD) 154, an optical disk drive 156, a disk emulator 160 connected to a solid-state drive (SSD) 164, an input/output (I/O) interface 170 connected to an add-on resource 174 and a trusted platform module (TPM) 176, a network interface 180, and a baseboard management controller (BMC) 190. Processor 102 is connected to chipset 110 via processor interface 106, and processor 104 is connected to the chipset via processor interface 108. In a particular embodiment, processors 102 and 104 are connected together via a high-capacity coherent fabric, such as a HyperTransport link, a QuickPath Interconnect, or the like. Chipset 110 represents an integrated circuit or group of integrated circuits that manage the data flow between processors 102 and 104 and the other elements of information handling system 100. In a particular embodiment, chipset 110 represents a pair of integrated circuits, such as a northbridge component and a southbridge component. In another embodiment, some or all of the functions and features of chipset 110 are integrated with one or more of processors 102 and 104.

Memory 120 is connected to chipset 110 via a memory interface 122. An example of memory interface 122 includes a Double Data Rate (DDR) memory channel and memory 120 represents one or more DDR Dual In-Line Memory Modules (DIMMs). In a particular embodiment, memory interface 122 represents two or more DDR channels. In another embodiment, one or more of processors 102 and 104 include a memory interface that provides a dedicated memory for the processors. A DDR channel and the connected DDR DIMMs can be in accordance with a particular DDR standard, such as a DDR3 standard, a DDR4 standard, a DDR5 standard, or the like.

Memory 120 may further represent various combinations of memory types, such as Dynamic Random-Access Memory (DRAM) DIMMs, Static Random-Access Memory (SRAM) DIMMs, non-volatile DIMMs (NV-DIMMs), storage class memory devices, Read-Only Memory (ROM) devices, or the like. Graphics adapter 130 is connected to chipset 110 via a graphics interface 132 and provides a video display output 136 to a video display 134. An example of a graphics interface 132 includes a Peripheral Component Interconnect-Express (PCIe) interface and graphics adapter 130 can include a four-lane (×4) PCIe adapter, an eight-lane (×8) PCIe adapter, a 16-lane (×16) PCIe adapter, or another configuration, as needed or desired. In a particular embodiment, graphics adapter 130 is provided down on a system printed circuit board (PCB). Video display output 136 can include a Digital Video Interface (DVI), a High-Definition Multimedia Interface (HDMI), a DisplayPort interface, or the like, and video display 134 can include a monitor, a smart television, an embedded display such as a laptop computer display, or the like.

NV-RAM 140, disk controller 150, and I/O interface 170 are connected to chipset 110 via an I/O channel 112. An example of I/O channel 112 includes one or more point-to-point PCIe links between chipset 110 and each of NV-RAM 140, disk controller 150, and I/O interface 170. Chipset 110 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. NV-RAM 140 includes BIOS/EFI module 142 that stores machine-executable code (BIOS/EFI code) that operates to detect the resources of information handling system 100, to provide drivers for the resources, to initialize the resources, and to provide common access mechanisms for the resources. The functions and features of BIOS/EFI module 142 will be further described below.

Disk controller 150 includes a disk interface 152 that connects the disc controller to a hard disk drive (HDD) 154, to an optical disk drive (ODD) 156, and to disk emulator 160. An example of disk interface 152 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 160 permits SSD 164 to be connected to information handling system 100 via an external interface 162. An example of external interface 162 includes a USB interface, an institute of electrical and electronics engineers (IEEE) 1394 (Firewire) interface, a proprietary interface, or a combination thereof. Alternatively, SSD 164 can be disposed within information handling system 100.

I/O interface 170 includes a peripheral interface 172 that connects the I/O interface to add-on resource 174, to TPM 176, and to network interface 180. Peripheral interface 172 can be the same type of interface as I/O channel 112 or can be a different type of interface. As such, I/O interface 170 extends the capacity of I/O channel 112 when peripheral interface 172 and the I/O channel are of the same type, and the I/O interface translates information from a format suitable to the I/O channel to a format suitable to the peripheral interface 172 when they are of a different type. Add-on resource 174 can include a data storage system, an additional graphics interface, a network interface card (NIC), a sound/video processing card, another add-on resource, or a combination thereof. Add-on resource 174 can be on a main circuit board, on a separate circuit board or add-in card disposed within information handling system 100, a device that is external to the information handling system, or a combination thereof.

Network interface 180 represents a network communication device disposed within information handling system 100, on a main circuit board of the information handling system, integrated onto another component such as chipset 110, in another suitable location, or a combination thereof. Network interface 180 includes a network channel 182 that provides an interface to devices that are external to information handling system 100. In a particular embodiment, network channel 182 is of a different type than peripheral interface 172, and network interface 180 translates information from a format suitable to the peripheral channel to a format suitable to external devices.

In a particular embodiment, network interface 180 includes a NIC or host bus adapter (HBA), and an example of network channel 182 includes an InfiniBand channel, a Fibre Channel, a Gigabit Ethernet channel, a proprietary channel architecture, or a combination thereof. In another embodiment, network interface 180 includes a wireless communication interface, and network channel 182 includes a Wi-Fi channel, a near-field communication (NFC) channel, a Bluetooth or Bluetooth-Low-Energy (BLE) channel, a cellular based interface such as a Global System for Mobile (GSM) interface, a Code-Division Multiple Access (CDMA) interface, a Universal Mobile Telecommunications System (UMTS) interface, a Long-Term Evolution (LTE) interface, or another cellular based interface, or a combination thereof. Network channel 182 can be connected to an external network resource (not illustrated). The network resource can include another information handling system, a data storage system, another network, a grid management system, another suitable resource, or a combination thereof.

BMC 190 is connected to multiple elements of information handling system 100 via one or more management interface 192 to provide out of band monitoring, maintenance, and control of the elements of the information handling system. As such, BMC 190 represents a processing device different from processor 102 and processor 104, which provides various management functions for information handling system 100. For example, BMC 190 may be responsible for power management, cooling management, and the like. The term BMC is often used in the context of server systems, while in a consumer-level device a BMC may be referred to as an embedded controller (EC). A BMC included at a data storage system can be referred to as a storage enclosure processor. A BMC included at a chassis of a blade server can be referred to as a chassis management controller and embedded controllers included at the blades of the blade server can be referred to as blade management controllers. Capabilities and functions provided by BMC 190 can vary considerably based on the type of information handling system. BMC 190 can operate in accordance with an Intelligent Platform Management Interface (IPMI). Examples of BMC 190 include an Integrated Dell® Remote Access Controller (iDRAC).

Management interface 192 represents one or more out-of-band communication interfaces between BMC 190 and the elements of information handling system 100, and can include an $I^2C$ bus, a System Management Bus (SMBUS), a Power Management Bus (PMBUS), a Low Pin Count (LPC) interface, a serial bus such as a Universal Serial Bus (USB) or a Serial Peripheral Interface (SPI), a network interface such as an Ethernet interface, a high-speed serial data link such as a Peripheral Component Interconnect-Express (PCIe) interface, a Network Controller Sideband Interface (NC-SI), or the like. As used herein, out-of-band access refers to operations performed apart from a BIOS/operating system execution environment on information handling system 100, that is apart from the execution of code by processors 102 and 104 and procedures that are implemented on the information handling system in response to the executed code.

BMC 190 operates to monitor and maintain system firmware, such as code stored in BIOS/EFI module 142, option ROMs for graphics adapter 130, disk controller 150, add-on resource 174, network interface 180, or other elements of information handling system 100, as needed or desired. In particular, BMC 190 includes a network interface 194 that can be connected to a remote management system to receive firmware updates, as needed or desired. Here, BMC 190 receives the firmware updates, stores the updates to a data storage device associated with the BMC, transfers the firmware updates to NV-RAM of the device or system that is the subject of the firmware update, thereby replacing the currently operating firmware associated with the device or system, and reboots information handling system, whereupon the device or system utilizes the updated firmware image.

BMC 190 utilizes various protocols and application programming interfaces (APIs) to direct and control the processes for monitoring and maintaining the system firmware. An example of a protocol or API for monitoring and maintaining the system firmware includes a graphical user interface (GUI) associated with BMC 190, an interface defined by the Distributed Management Taskforce (DMTF) (such as a Web Services Management (WSMan) interface, a Management Component Transport Protocol (MCTP) or, a Redfish® interface), various vendor-defined interfaces (such as a Dell EMC Remote Access Controller Administrator (RACADM) utility, a Dell EMC OpenManage Server Administrator (OMSS) utility, a Dell EMC OpenManage Storage Services (OMSS) utility, or a Dell EMC OpenManage Deployment Toolkit (DTK) suite), a BIOS setup utility such as invoked by a "F2" boot option, or another protocol or API, as needed or desired.

In a particular embodiment, BMC 190 is included on a main circuit board (such as a baseboard, a motherboard, or any combination thereof) of information handling system 100 or is integrated onto another element of the information handling system such as chipset 110, or another suitable element, as needed or desired. As such, BMC 190 can be part of an integrated circuit or a chipset within information handling system 100. An example of BMC 190 includes an iDRAC or the like. BMC 190 may operate on a separate power plane from other resources in information handling system 100. Thus BMC 190 can communicate with the management system via network interface 194 while the resources of information handling system 100 are powered off. Here, information can be sent from the management system to BMC 190 and the information can be stored in a RAM or NV-RAM associated with the BMC. Information stored in the RAM may be lost after power-down of the power plane for BMC 190, while information stored in the NV-RAM may be saved through a power-down/power-up cycle of the power plane for the BMC.

Information handling system 100 can include additional components and additional busses, not shown for clarity. For example, information handling system 100 can include multiple processor cores, audio devices, and the like. While a particular arrangement of bus technologies and interconnections is illustrated for the purpose of example, one of skill in the art will appreciate that the techniques disclosed herein are applicable to other system architectures. Information handling system 100 can include multiple CPUs and redundant bus controllers. One or more components can be integrated together. Information handling system 100 can include additional buses and bus protocols, for example, $I^2C$ and the like. Additional components of information handling system 100 can include one or more storage devices that can store machine-executable code, one or more communications ports for communicating with external devices, and various input and output (I/O) devices, such as a keyboard, a mouse, and a video display.

For purpose of this disclosure information handling system 100 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 100 can be a personal computer, a laptop computer, a smartphone, a tablet device or other consumer electronic device, a network server, a network storage device, a switch, a router, or another network communication device, or any other suitable device and may vary in size, shape, performance, functionality, and price. Further, information handling system 100 can include processing resources for executing machine-executable code, such as processor 102, a programmable logic array (PLA), an embedded device such as a System-on-a-Chip (SoC), or other control logic hardware. Information handling system 100 can also include one or more computer-readable media for storing machine-executable code, such as software or data.

Fast response time of a liquid crystal display (LCD) gaming monitor is desirable. Overdrive technology is a common method to enhance the response time of LCD monitors and is generally implemented using a frame buffer. Typically a scaler unit, also known as a scaler, with embedded or external frame buffers is used to boost the response time of an LCD monitor. However, scalers with embedded or external frame buffer are generally more expensive than scalers without frame buffers. The present disclosure includes a system and method to control multiple response times in the LCD monitor by leveraging the frame buffer in the LCD monitor instead of using a scaler with a frame buffer.

Figure 2:
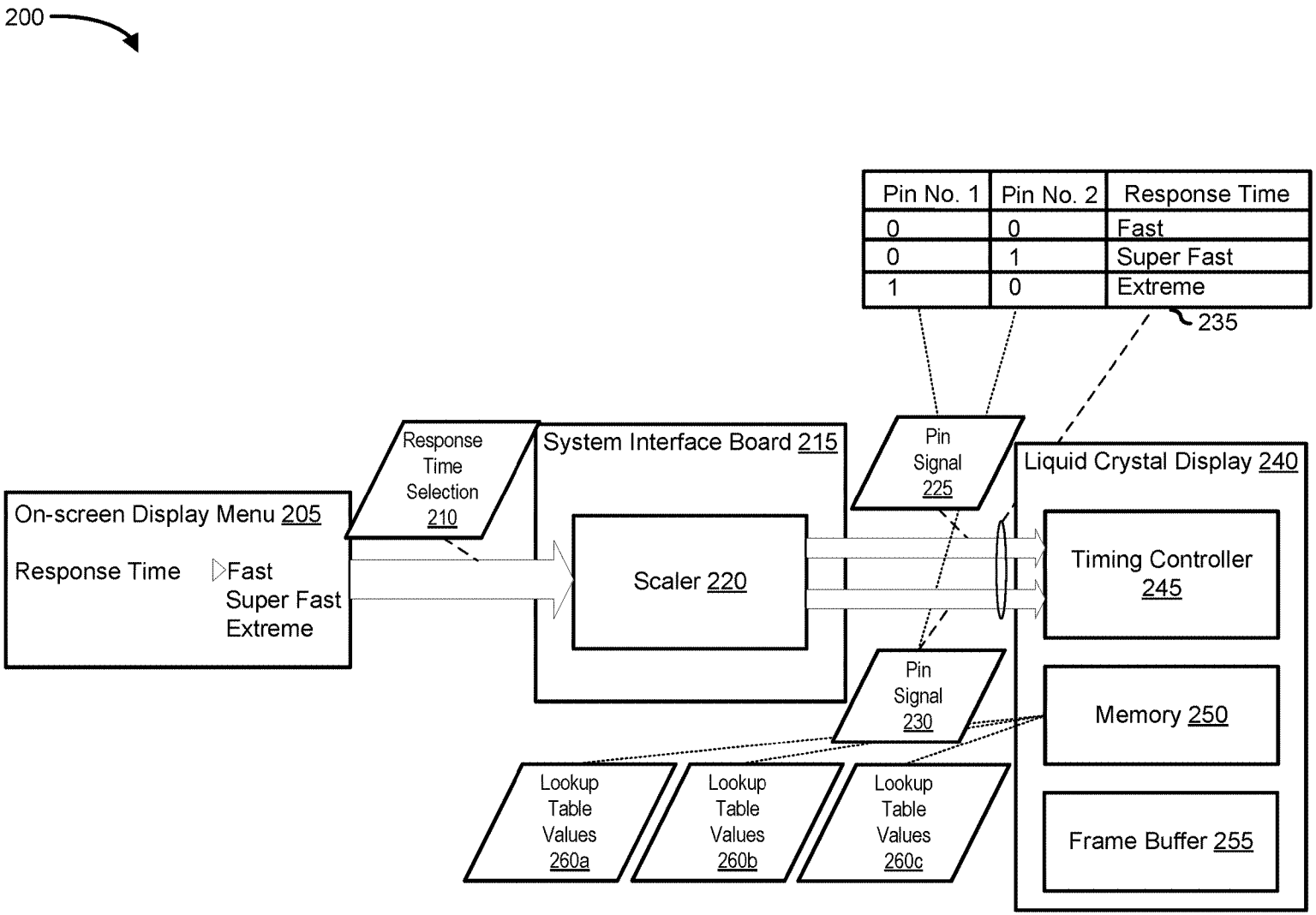
FIG. 2 is a block diagram illustrating an example of a system for overdrive setting control on liquid crystal displays (LCDs), according to an embodiment of the present disclosure.

FIG. 2 illustrates a system 200 for controlling lookup table values to support overdrive settings such as response times via timing controller pins. System 200 includes an on-screen display menu 205, a system interface board 215, and an LCD 240. System interface board 215 includes a scaler 220. LCD 240 includes a timing controller 245, a memory 250, and a frame buffer 255. System 200 may be configured to manipulate the lookup table values of a timing controller on an LCD using timing controller pins also referred to as selection pins of timing controller 245 dedicated to the overdrive settings or simply pins.

LCD 240 is configured to receive a video signal from a source, such as a computer, a digital video disc (DVD) player, etc. and display the video signal via system interface board 215. Frame buffer 255 is a memory that stores the video signal of an image to be displayed at LCD 240. Timing controller 245 receives the pixels from scaler 220 in a serial format and generates horizontal and vertical timing panel signals. In addition, timing controller 245 includes pins dedicated to select the lookup table values during a vertical blank period also referred to as a vertical blank period. The pins may be referred herein as "pin one" and "pin two." The number of pins and entries in a truth table 235 may depend on the number of overdrive options such as response time options. The look-up table is used to decide how much voltage is needed to apply to the pins. The liquid crystals may change their state based on the applied voltage which in turn causes the response time to change. In this example, two pins along with three lookup table entries as shown truth table 235 may be enough for three overdrive options or three response time options. Those skilled in the art will readily appreciate that the number of the timing controller pins and the size of the lookup table may be modified based on the number of the overdrive setting options of the LCD monitor.

On-screen display menu 205 includes one or more adjustments for ease of setup and screen optimization of LCD 240. On-screen display menu 205 includes a menu to adjust an overdrive setting such as the response time, wherein a user can select between one or more response times. Response time may include a normal mode, fast mode, super-fast mode, or extreme mode. The selected response time is transmitted to scaler 220 of system interface board 215, such as via a response time selection 210. Based on response time selection 210, scaler 220 determines the value of to be applied "pin one" and "pin two" based on truth table 235.

Pin signal 225 is associated with pin one while pin signal 230 is associated with pin two. For example, based on truth table 235, if the user chose extreme for the response time, then the value of pin signal 225 is equal to one, and the value of pin signal 230 is equal to zero. The value of the pin signal may refer to the strength of the signal or the voltage to be applied to the associated pin. For example, if the value of pin signal 225 is one, then a high voltage may be applied to pin one." If the value of pin signal 230 is zero, then a low voltage may be applied to pin two.

Timing controller 245 may be configured to adjust the response time based on input signals in the dedicated pins using frame buffer 255. In this example, timing controller 245 has lookup table values stored in memory 250 such as lookup table values 260*a* to lookup table values 260*c*. Here, lookup table values 260*a* may include entries associated with the fast mode. Lookup table values 260*b* may include entries associated with the super-fast mode. Lookup table values 260*c* may include entries associated with the extreme mode. If the response time setting was changed from the fast mode to the extreme mode, then timing controller 245 may change the lookup table values from lookup table values 260*a* to lookup table values 260*c*.

Figure 3:
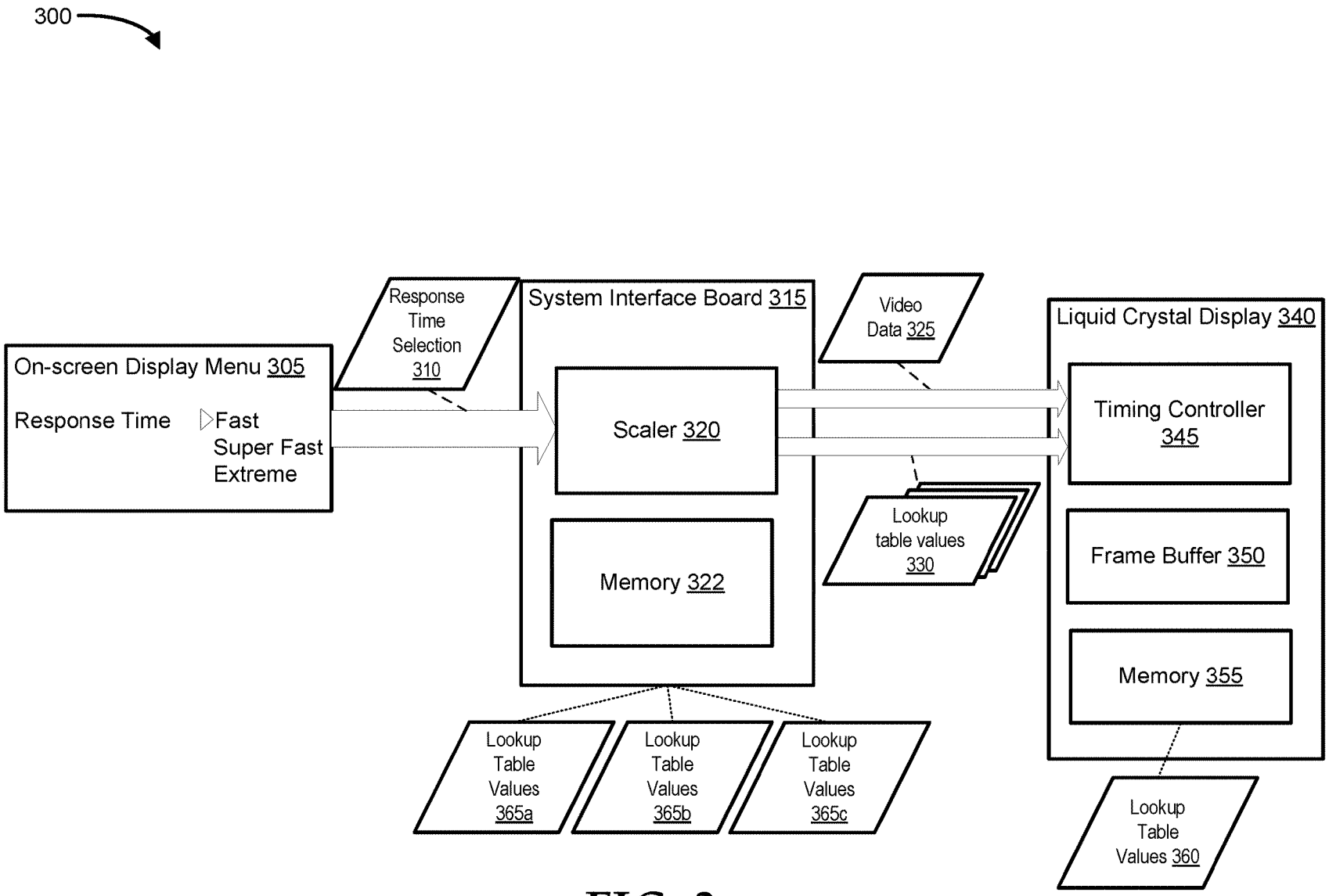
FIG. 3 is a block diagram illustrating an example of a system for overdrive setting control on LCDs, according to an embodiment of the present disclosure.

FIG. 3 illustrates a system 300 for manipulating lookup table values to control overdrive settings using data transmitted via the $I^2C$ bus. System 300 includes an on-screen display menu 305, a system interface board 315, an LCD 340. System interface board 315 includes a scaler 320 and memory 322. LCD 340 includes a timing controller 345, a frame buffer 350, and a memory 355. LCD 340 is configured to receive a video signal from a source, such as a computer, a digital video disc (DVD) player, etc. via system interface board 315 and displays the video signal on an LCD panel. Timing controller 345 receives the pixels from scaler 320 in a serial format and generates horizontal and vertical timing panel signals. Frame buffer 350 is a memory that stores the pixels and associated data of an image to be displayed.

On-screen display menu 305 includes one or more adjustments for ease of setup and screen optimization of LCD 340. For example, on-screen display menu 305 includes a menu to adjust response times, wherein a user can select between various values such as normal, fast, super-fast, or extreme. The selected response time is transmitted to scaler 320 of system interface board 315, such as via response time selection 310. Based on response time selection 310, scaler 320 determines video data 325 and lookup table values 330. After determining the aforementioned values, scaler 320 transmits video data 325 and lookup table values 330 to timing controller 345. Video data 325 may include pixels for one or more video frames for display. Video data 325 may include low-voltage differential signaling (LVDS), embedded displayPort (eDP), V-by-One HS, etc.

Timing controller 345 implements lookup table values for the current response time, such as lookup table values 360, which is stored at memory 355. If the user changes the response time, scaler 320 transmits the lookup table values associated with the new response time. Lookup table values 330 may be one of lookup table values 365*a*, lookup table values 365*b*, or lookup table values 365*c* which are stored in memory 322. Assuming that lookup table values 365*a* includes overdrive values for the fast mode, lookup table values 365*b* includes overdrive values for the super-fast mode, and lookup table values 365*c* includes overdrive values for the extreme mode, and the new overdrive setting is changed to the extreme mode from the fast mode, then lookup table values 330 may be equivalent to lookup table values 365. Lookup table values 330 may be used to overwrite lookup table values 360 in memory 355.

Table 1 shown below is an example of a lookup table. The values in bold that are associated with the previous frame are the gray levels of the previous frame. The values in bold that are associated with the current vertical frame are the gray levels of the current vertical frame. The entries in the table are overdrive values for that frame and gray level.

TABLE 1

| Lookup Table | | | | | | | | | |
|---|---|---|---|---|---|---|---|---|---|
| | | Previous Frame | | | | | | | |
| | | **0** | **64** | **128** | **192** | **256** | **320** | **384** | **448** |
| Current Frame | **0** | 0 | 0 | 0 | 0 | 0 | 0 | 0 | 0 |
| | **64** | 100 | 64 | 40 | 36 | 28 | 24 | 20 | 20 |
| | **128** | 296 | 212 | 128 | 112 | 96 | 88 | 80 | 76 |
| | **192** | 372 | 296 | 220 | 192 | 168 | 144 | 132 | 120 |
| | **256** | 450 | 368 | 292 | 268 | 256 | 232 | 212 | 196 |
| | **320** | 510 | 432 | 384 | 352 | 344 | 320 | 300 | 288 |
| | **384** | 580 | 504 | 464 | 448 | 424 | 404 | 384 | 360 |
| | **448** | 624 | 592 | 552 | 532 | 508 | 484 | 468 | 448 |
| | **512** | 696 | 676 | 640 | 624 | 608 | 584 | 552 | 528 |

Figure 4:
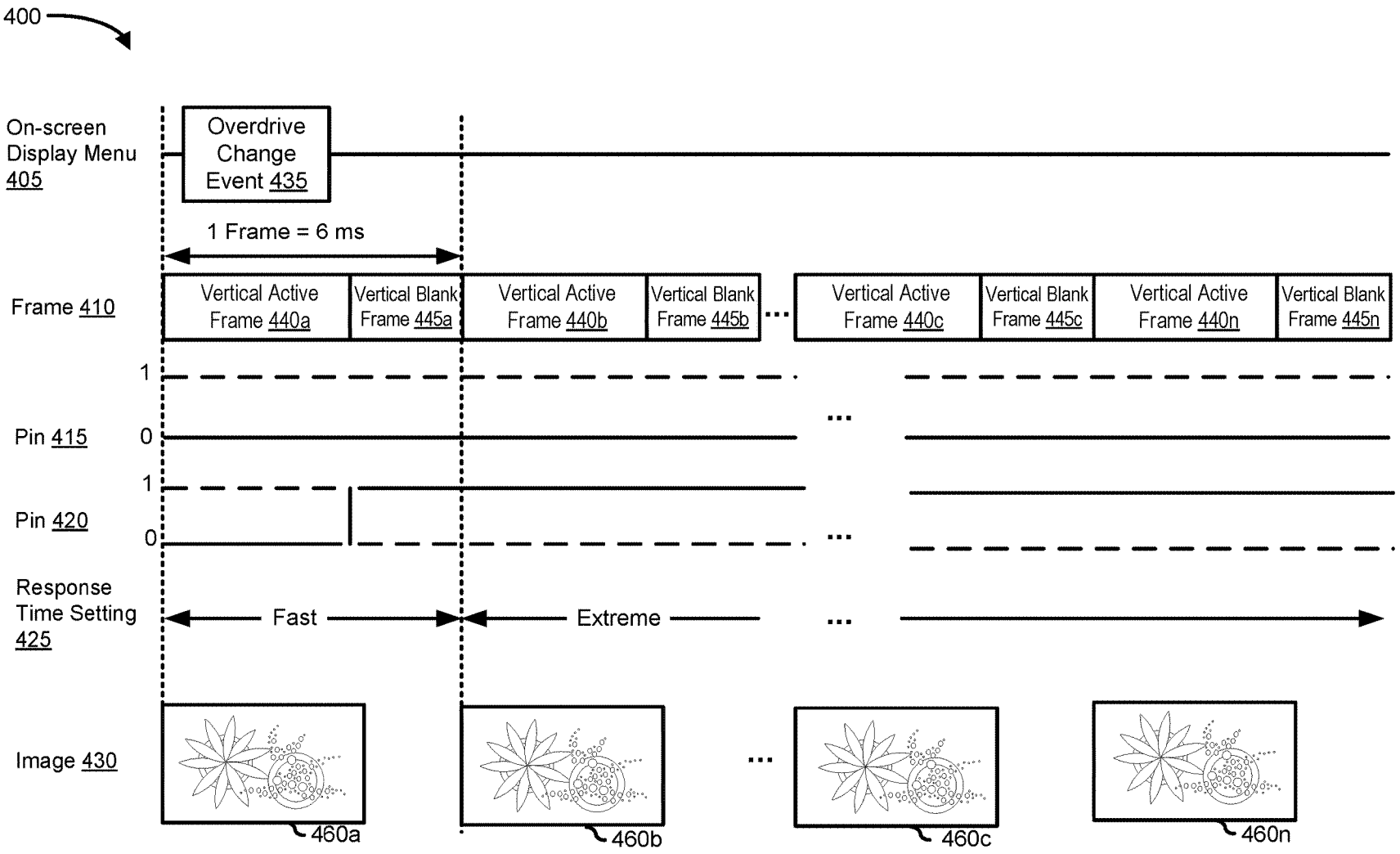
FIG. 4 is a timing diagram illustrating an overdrive setting control on LCDs, according to an embodiment of the present disclosure.

FIG. 4 shows a timing diagram 400 for controlling lookup table values to support overdrive settings such as a response time via timing controller pins. Timing diagram 400 includes an on-screen display menu 405, a frame 410, a pin 415, a pin 420, a response time setting 425, and an image 430 which includes an image 460*a* to an image 460*n*. Frame 410 includes vertical active frame 440*a* to vertical active frame 440*n* and vertical blank frame 445*a* to vertical blank frame 445*n*. Typically, a vertical blank frame follows a vertical active frame. The vertical blank frame occurs during a vertical blank period. A vertical active frame occurs during a vertical active frame. During the period of vertical active frame 440*a*, image 460*a* is displayed at the LCD monitor while during the period of vertical active frame 440*b*, image 460*b* is displayed. During the period of vertical active frame 440*c*, image 460*c* is displayed, and so on, wherein during the period of vertical active frame 440*n*, image 460*n* is displayed.

On-screen display menu 405 is similar to on-screen display menu 205 of FIG. 2, wherein a user can change an overdrive setting such as the response time of an LCD monitor. If a user changes the overdrive setting an on-screen display menu, then an overdrive change event may be triggered. When the scaler detects overdrive change event 435, the scaler changes the state of pin 415 and pin 420 by applying a high voltage or a low voltage. The state of pin 415 and pin 420 may be used to select the response time of the LCD monitor. The state of pin 415 may be based on lookup table entries stored in a memory accessible by the timing controller. The change to the state of the pins may be implemented during the vertical blank period of a vertical synchronizing signal.

The number of dedicated pins and the size of an overdrive lookup table herein simply as a lookup table, depending on the number of overdrive options of the LCD monitor. In this example, the LCD monitor has three overdrive options such that two dedicated pins and three entries in the lookup table are enough to control the overdrive settings of the LCD monitor. Those skilled in the art will readily appreciate that the number of dedicated pins and the size of the lookup table may be modified based on the number of the overdrive setting options of the LCD monitor.

In one example, a user changes the overdrive setting in an on-screen display menu 405 from fast mode to extreme mode which generates an overdrive change event 435. Based on a lookup table such as truth table 235 of FIG. 2, the scaler may change the setting of pin number one from zero to one and the value of pin number two will remain at zero. Here, pin 415 is mapped to pin number two, and pin 420 is mapped to pin one.

A frame period includes the vertical active period and the vertical blank period. Accordingly, a whole frame includes a vertical active frame and a vertical blank frame. The vertical active frame, such as vertical active frame 440*a*, is wherein data signals are transmitted. Thus, during a vertical active frame, an image is displayed on the LCD monitor. Here, image 460*a* is displayed during vertical active frame 440. A vertical blank frame, such as vertical blank frame 445*a*, is wherein no data signals are transmitted. Thus, during a vertical blank frame, no image is displayed, as depicted by a space between image 460*a* and image 460*b*. A frame period includes an activation period and a vertical blank period. One frame period is a time required to display the data of one frame on the LCD panel and is equal to a sum of one vertical active period and one vertical blank period. In this example, a single frame period, which includes a vertical active frame 440*a* and vertical blank frame 445*a*, lasts for six milliseconds.

Changing the setting of either pin 415 or pin 420 may only be applied during the vertical blank period. Because overdrive change event 435 was generated during the period of vertical active frame 440*a*, the scaler may have to wait until the start or beginning of vertical blank frame 445*a*, which is the next vertical blank frame, before it can apply the change to pin 415 and pin 420. Because pin 415 is already set to zero, no change is applied to the setting of pin 415.

Because the change to the voltage setting of pin 420 from zero to one is applied at the beginning of vertical blank frame 445*a*, response time setting 425 is changed to the extreme mode from fast mode at the beginning of vertical active frame 440*b* or image 460*b* which is the next active frame. Here, if the value of zero may refer to low voltage and the value of one may refer to high voltage, then at the beginning of vertical blank frame 445*a*, a high voltage is applied at pin 420. For example, at the start of vertical blank frame 445*a*, five volts is applied to pin 420. The change to the response time is then operational in the next vertical frame. For example, the change of response time setting 425 from fast mode to extreme mode is operational at vertical active frame 440*b* which displays image 460*b*. The extreme mode is operational until a new overdrive change event is detected by the scaler.

Figure 5:
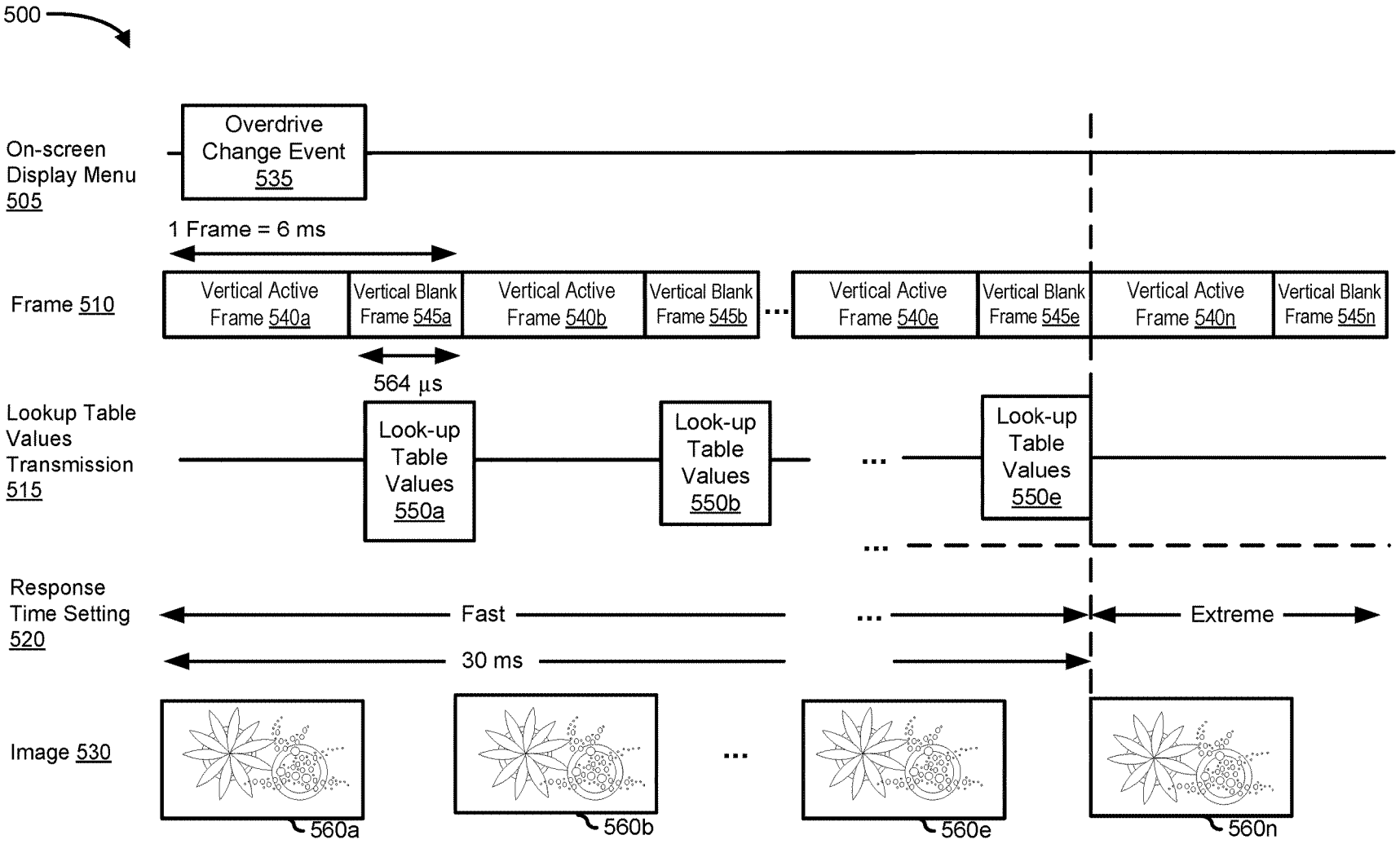
FIG. 5 is a timing diagram illustrating an overdrive setting control on LCDs, according to an embodiment of the present disclosure.

FIG. 5 shows a timing diagram 500 for controlling an overdrive setting on an LCD by applying lookup table values over $I^2C$ communication. Timing diagram 500 includes an on-screen display menu 505, a frame 510, a lookup table values transmission 515, a response time setting 520, and an image 530. Frame 510 includes vertical active frame 540*a* to vertical active frame 540*n*. Frame 510 also includes vertical blank frame 545*a* to vertical blank frame 545*n*. During the period of vertical active frame 540*a*, image 560*a* is displayed at the LCD monitor while during the period of vertical active frame 540*b*, image 560*b* is displayed, and so on. Similarly, during the period of vertical active frame 540*e*, image 560*e* is shown, and so on through vertical active frame 540*n* wherein image 560*n* is displayed.

On-screen display menu 505 is similar to on-screen display menu 305 of FIG. 3, wherein a user can change an overdrive setting such as the response time of an LCD monitor. If a user changes the overdrive setting, then overdrive change event 535 may be triggered. The scaler upon detecting overdrive change event 535 may then transmit lookup table values associated with overdrive change event 535 to the timing controller of the LCD monitor via the $I^2C$ bus. The lookup table values may overwrite the current lookup table values located in an internal memory of the timing controller. The timing of when updated lookup table values will be in effect may depend on the transmission period, such as lookup table values transmission 515, of the lookup table values over the $I^2C$ bus.

In one example, the user changes the overdrive setting in on-screen display menu 505 from fast mode to extreme mode which generates overdrive change event 535. Overdrive change event 535 was generated during the period of vertical active frame 540*a*. As the change to the overdrive setting can be applied during a vertical blank period, the scaler may wait for vertical blank frame 445*a* to transmit the lookup table values or a portion thereof such as lookup table values 550*a*. If the lookup table values cannot be transmitted entirely during the vertical blank period, then the rest of the remaining lookup table values may be transmitted in portions or batches over the next vertical blank periods. For example, lookup table values For example, a scaler will send a set of lookup table values associated with the new overdrive setting or new response time which may be used to overwrite a current set of lookup table values used by the timing controller. For example, if the timing controller implements lookup table values associated with super-fast mode response time and the user changes the response time to extreme mode, then the scaler may transmit lookup table values associated with the extreme mode to overwrite the values of the current implemented lookup table values.

The size of the lookup table values to be transmitted over the $I^2C$ bus may depend on various factors such as the overdrive logic design. In one example, the LCD monitor has a built-in overdrive function that uses a 319-byte lookup table. Assuming that the speed of the $I^2C$ bus is 1 MHz, sending the 319-byte lookup table values may take 2.5 milliseconds. For illustration purposes, let's assume that the LCD monitor is a quad high definition (QHD) monitor operating at 165 Hz the duration of a vertical blank period, such as vertical blank frame 545*a*, is approximately 564 microseconds. Because the 319-byte lookup table values may take 2.5 milliseconds to be transmitted, the vertical blank frame 545*a* is insufficient to transmit all of the lookup table values over the $I^2C$ bus within a single vertical blank frame. Thus, the scaler may have to transmit a portion of the lookup table values over the vertical blank periods of several frames. Here, the 319-byte lookup table values may have to be transmitted in five frames, which is about 30 milliseconds. In this example, the lookup table values may be written to the internal memory over five vertical blank frames, such as vertical blank frame 545*a*, vertical blank frame 545*b* through vertical blank frame 545*e*. In particular, a portion of lookup table values may be written at each vertical blank frame period. For example, assuming that the lookup table values are divided into five portions, lookup table values 550*a* to lookup table values 550*e*, then lookup table values 550*a* may be written to the internal memory during vertical blank frame 545*a*, overdrive lookup table values 550*b* may be written during vertical blank frame 545*b*, and so on until lookup table values 550*e* which may be written during vertical blank frame 545*e*. After writing the last portion or last batch of the lookup table values, that is lookup table values 550*e*, the LCD monitor may operate using the extreme mode response time at the next vertical active frame, vertical active frame 540*n*.

Figure 6:
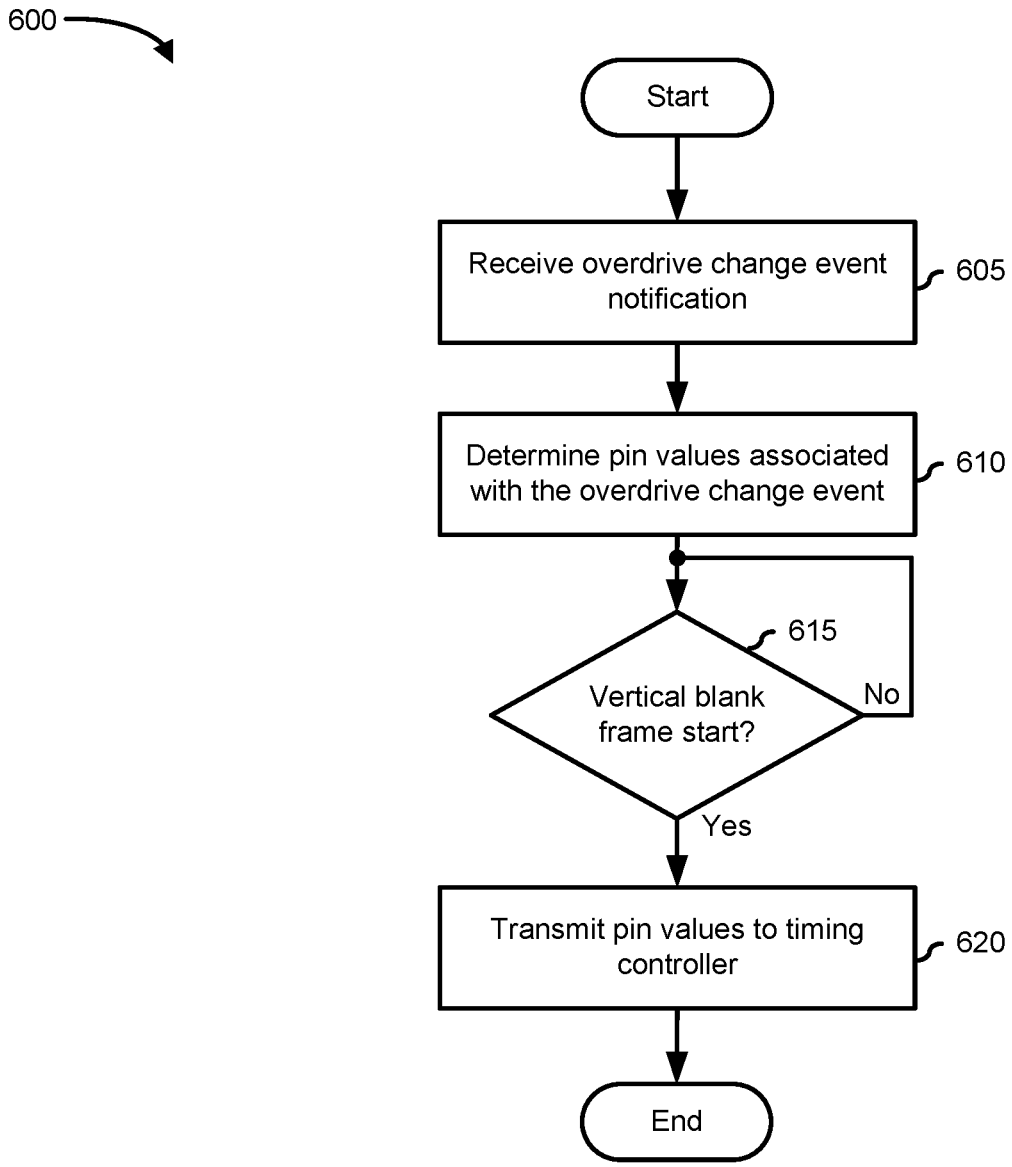
FIG. 6 is a flowchart illustrating an example of a method for overdrive setting control on LCDs, according to an embodiment of the present disclosure.

FIG. 6 illustrates a method 600 for overdrive setting control on LCDs using timing controller pins. In particular, method 600 may update the state of the timing controller pins during a vertical blank period based on lookup table values associated with the change in the overdrive setting. While embodiments of the present disclosure are described in terms of system 200, or in particular of scaler 220 of FIG. 2, it should be recognized that other systems may be utilized to perform the described method. FIG. 6 typically starts at block 605 where an overdrive change event notification may be received by the scaler. After receiving the change event notification, the method proceeds to block 610.

At block 610, the method determines values to which the pins of the timing controller dedicated to overdrive settings would be updated too. The pin values may be based on the lookup table values associated with the new overdrive setting. After determining the pin values, the method proceeds to decision block 615 where the method determines whether it's the start of a vertical blank period. If it is the start of the vertical blank period, then the "YES" branch is taken, and the method proceeds to block 620. If it is not the start of the vertical blank period, then the "NO" branch is taken, and the method loops back to decision block 615. At block 620, the method transmits the pin values for the dedicated pins to the timing controller. After transmitting the pin values to the timing controller, the LCD monitor operates using the updated overdrive settings at the next vertical active frame and the method ends.

Figure 7:
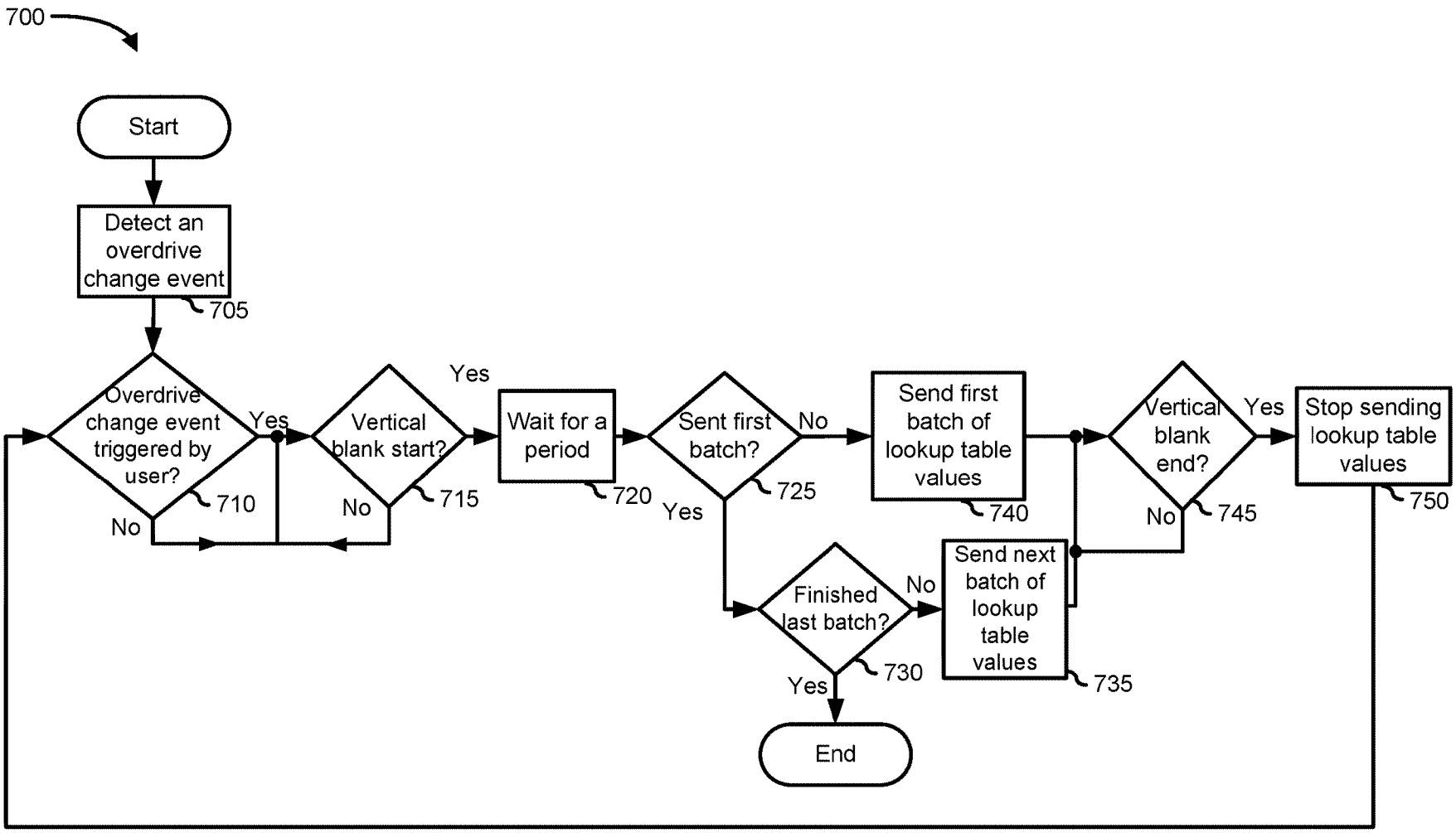
FIG. 7 is a flowchart illustrating an example of a method for overdrive setting control on LCDs, according to an embodiment of the present disclosure.

FIG. 7 illustrates a method 700 for performing for controlling an overdrive setting on an LCD by applying lookup table values over $I^2C$ communication. In particular, method 700 updates the state of the timing controller pins to control the overdrive setting during a vertical blank period. While embodiments of the present disclosure are described in terms of system 200, in particular in terms of scaler 320 of FIG. 3, it should be recognized that other systems may be utilized to perform the described method. FIG. 7 typically starts at block 705 where the method detects an overdrive event notification. An overdrive event notification may be received from an on-screen display menu.

The method proceeds to decision block 710 where the method determines whether the received overdrive event is an overdrive change event that is triggered by a user. The overdrive event may be generated when the user changes an overdrive setting such as response time at an on-screen display menu. If the overdrive change event is triggered by the user, then the "YES" branch is taken, and the method proceeds to decision block 715. If the overdrive change event is not triggered by the user, then the "NO" branch is taken, and the method proceeds to decision block 715.

At decision block 715, the method determines whether it is the start of a vertical blank period. If the method determines that it is the start of the vertical blank period, then the "YES" branch is taken, and the method proceeds to block 720. If the method determines that it is not the start of the vertical blank period, then the "NO" branch is taken, and the method loops back to decision block 715.

At block 720, the method waits until it reaches a certain threshold such as a period or a set number of lines. The manufacturer of the LCD monitor or an administrator may determine the period or number of lines for waiting. One line is equal to one data enable signal. For example, a QHD LCD monitor may have 2560 horizontal lines and 1440 vertical lines. A vertical blank frame may include 41 lines while a vertical active frame may include 1440 lines. In this example, the method may wait for at least three lines at the start of the vertical blank frame and start sending the lookup table values at the fourth line. After waiting, the method proceeds to decision block 725, where the method determines whether a first batch of the overdrive change event lookup table values have already been transmitted to the timing controller. If the first batch of the overdrive change event lookup table values have already been transmitted, then the "YES" branch is taken, and the method proceeds to decision block 730. If the first batch of the lookup table values have not been transmitted, then the "NO" branch is taken, and the method proceeds to block 740 where the method sends the first batch of the lookup table values.

At decision block 730, the method determines whether the last batch of the lookup table values has been transmitted to the timing controller. If the last batch of the lookup table values has been transmitted to the timing controller, then the "YES" branch is taken, and the method ends. If the last batch of the lookup table values has not been transmitted to the timing controller, then the "NO" branch is taken, and the method proceeds to block 735.

At block 735, the method sends the next batch of lookup table values to the timing controller. The method then proceeds to decision block 745. At decision block 745, the method determines whether it is the end of the vertical blank period. If the method determines that it is the end of the vertical blank period, then the "YES" branch is taken, and the method proceeds to block 750. If the method determines that it is not the end of the vertical blank period, then the "NO" branch is taken, and the method proceeds to decision block 710. At block 750, the method stops sending lookup table values and proceeds to decision block 710.

Figure 8:
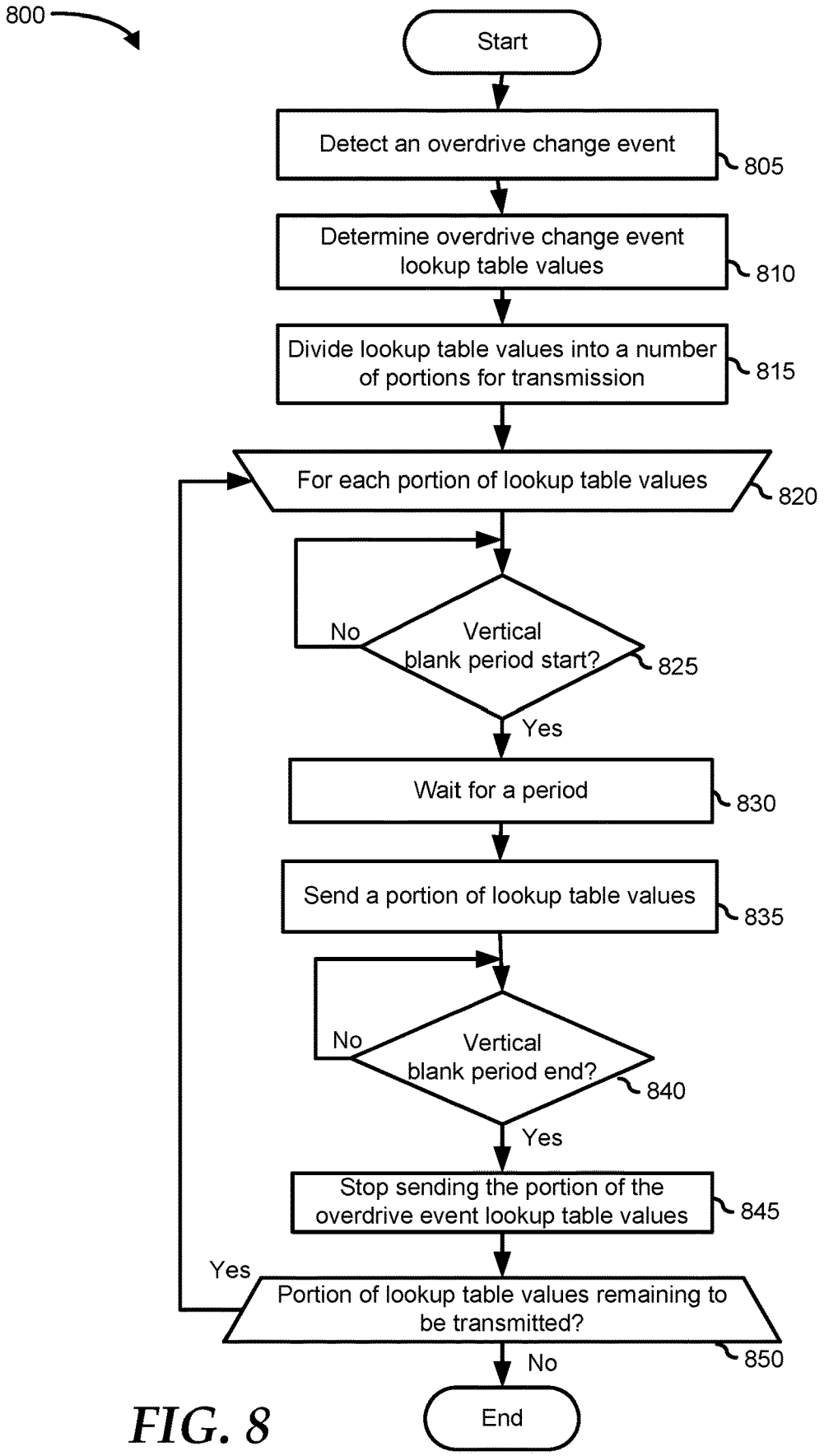
FIG. 8 is a flowchart illustrating an example of a method for overdrive setting control on LCDs, according to an embodiment of the present disclosure.

FIG. 8 illustrates a method 800 for controlling overdrive settings using timing controller pins. Method 800 updates the state of the timing controller pins during a vertical blank period. While embodiments of the present disclosure are described in terms of system 200, in particular in terms of scaler 320 of FIG. 3 it should be recognized that other systems may be utilized to perform the described method. FIG. 8 typically starts at block 805 where the method detects an overdrive change event that may have been triggered by a user changing an overdrive setting such as response time at an on-screen display, via a command-line interface, a script, a joystick, an application, etc. After detecting the overdrive change event, the method proceeds to block 810 where the method determines the lookup table values associated with the overdrive change event.

After determining the change event lookup table values, the method proceeds to block 815 where the method divides the lookup table values into a number of portions or batches for transmitting the lookup table values based on one or more factors such as the size of the lookup table values, the speed of the $I^2C$ bus, and the length of the vertical blank period. The method proceeds to block 820, where it evaluates each portion or batch of the lookup table values starting at decision block 825. The description will refer a portion, or a batch of the lookup table being processed as the "current portion of lookup table values."

At decision block 825, the method determines whether it is the start of the vertical blank period. If it is the start of the vertical blank period, the method takes the "YES" branch and proceeds to block 830. If it is not the start of the vertical blank period, then the "NO" branch is taken, and the method loops back to decision block 825. At block 830, the method may wait for a length of time or a number of lines. The length of time may be pre-determined at the manufacturer or an administrator of the information handling system. The wait is a safety margin that allows an unexpected voltage change within the LCD to settle down. The method proceeds to block 835, where it transmits a portion or a batch of the lookup table values to the timing controller. The method may transmit the portion or the batch of the lookup table values until the vertical blank period ends or there is no more data to be transmitted. At decision block 840, the method determines whether it is the end of the vertical blank period. If it is the end of the vertical blank period, then the "YES" branch is taken, and the method proceeds to block 845. If it is not the end of the vertical blank period, then the "NO" branch is taken, and the method loops back to decision block 840.

At block 845, the method stops sending the current portion of the lookup table values. If the method has not finished sending the current portion of the lookup table values, then the method may add the unsent portion of the current portion to the portions or batches of lookup table values to be processed as another portion or batch of lookup table values. The method proceeds to block 850.

At block 850, the method determines if there is another portion or batch of lookup table values remaining to be transmitted. If there is another portion or batch of the lookup table values to be transmitted, then the "YES" branch is taken, and the method proceeds to block 820. If there is no portion or batch of the lookup table values to be transmitted, then the "NO" branch is taken, and the method ends.

Although FIG. 6, FIG. 7, and FIG. 8 show example blocks of method 600, method 700, and method 800 in some implementation, method 600, method 700, and method 800 may include additional blocks, fewer blocks, different blocks, or differently arranged blocks than those depicted in FIG. 6, FIG. 7, and FIG. 8. Additionally, or alternatively, two or more of the blocks of method 600, method 700, and method 800 may be performed in parallel. For example, decision block 725 and decision block 730 of method 700 may be performed in parallel.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions or receives and executes instructions responsive to a propagated signal; so that a device connected to a network can communicate voice, video, or data over the network. Further, the instructions may be transmitted or received over the network via the network interface device.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or another storage device to store information received via carrier wave signals such as a signal communicated over a transmission medium. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents but also equivalent structures.

What is claimed is:

1. A monitor of an information handling system, comprising:

a timing controller coupled to a liquid crystal display panel, wherein the timing controller includes a first pin and a second pin; and a scaler unit coupled to the timing controller, the scaler unit configured to:

receive a change event notification associated with a change to a new overdrive setting of the liquid crystal display panel;

in response to the receipt of the change event notification, determine a set of lookup table values associated with the change to the new overdrive setting of the liquid crystal display panel, wherein the set of lookup table values includes a first pin value and a second pin value, and wherein the set of lookup table values are used to change states of the first pin and the second pin; and transmit the first pin value to the first pin and the second pin value to the second pin during a vertical blank period.

2. The monitor of claim 1, wherein the change to the new overdrive setting is a particular change in response time of the liquid crystal display panel.

3. The monitor of claim 1, wherein the first pin and the second pin are external pins.

4. The monitor of claim 1, wherein the scaler unit is further configured to detect the change to the new overdrive setting.

5. The monitor of claim 1, wherein the liquid crystal display panel is configured to use the new overdrive setting at a start of a vertical active period after the vertical blank period.

6. The monitor of claim 1, wherein the change event notification is generated when a user changes an overdrive setting at an on-screen display menu to the new overdrive setting.

7. A non-transitory computer-readable medium including code that when executed performs a method, the method comprising:

receiving a change event notification associated with a change to a new overdrive setting of a liquid crystal display;

in response to the receiving the change event notification, determining a first pin value of a first pin of a timing controller and a second pin value of a second pin of the timing controller, wherein the first pin value and the second pin value are associated with the new overdrive setting of the liquid crystal display, and wherein the first pin value and the second pin value are applied by a scaler unit associated with the liquid crystal display; and applying the first pin value to the first pin of the timing controller and applying the second pin value to the second pin of the timing controller of the liquid crystal display.

8. The non-transitory computer-readable medium of claim 7, wherein the change event notification is generated when a user changes an overdrive setting at an on-screen display menu to the new overdrive setting.

9. The non-transitory computer-readable medium of claim 7, wherein the change to the new overdrive setting is a particular change in response time of the liquid crystal display.

10. The non-transitory computer-readable medium of claim 7, wherein the determining the first pin value and the second pin value is based on a lookup table associated with overdrive settings.

11. The non-transitory computer-readable medium of claim 10, wherein the lookup table is stored at a memory associated with the timing controller.

12. The non-transitory computer-readable medium of claim 7, wherein the liquid crystal display operates using the new overdrive setting at a vertical active period after a vertical blank period.

13. A monitor of an information handling system, comprising:

a timing controller coupled to a liquid crystal display panel; and a scaler unit coupled to the timing controller via an inter-integrated circuit bus, the scaler unit configured to:

receive a change event notification associated with a change to a new overdrive setting of the liquid crystal display panel;

in response to the receipt of the change event notification, determine a set of lookup table values associated with the change to the new overdrive setting of the liquid crystal display panel;

divide data to be transmitted into data portions based on factors that include length of a vertical blank period and speed of the inter-integrated circuit bus; and transmit one of the data portions during the vertical blank period via the inter-integrated circuit bus.

14. The monitor of claim 13, wherein the change to the new overdrive setting is a particular change in response time of the liquid crystal display panel.

15. The monitor of claim 13, further comprising stopping the transmitting of the one of the data portions at end of the vertical blank period.

16. The monitor of claim 13, further comprising transmitting another data portion of the data portions during another vertical blank period.

17. The monitor of claim 13, further comprising determining whether the vertical blank period is starting prior to transmitting the one of the data portions.

18. The monitor of claim 13, further comprising determining whether last one of the data portions has been transmitted.

19. The monitor of claim 13, wherein the liquid crystal display panel starts operating at the new overdrive setting at a beginning of a vertical active frame after transmission of the data portions.

* * * * *